US005588153A

United States Patent [19]

Ignon et al.

[11] Patent Number: 5,588,153

[45] Date of Patent: Dec. 31, 1996

[54] SURGICAL GOWN

[75] Inventors: Roger G. Ignon, Palos Verdes Estates; Ronald E Thomas, Jr., Alta Loma, both of Calif.

[73] Assignee: Stackhouse, Inc., Riverside, Calif.

[21] Appl. No.: 440,495

[22] Filed: Apr. 28, 1995

[51] Int. Cl.[6] ..... A41D 13/00

[52] U.S. Cl. ..... 2/457; 2/46; 2/52; 2/69; 2/458; 2/84; 2/114; 2/901; 128/201.29; 128/201.18

[58] Field of Search ..... 2/2, 2.11, 2.14, 2/2.15, 46, 52, 69, 69.5, 94, 84, 85, 87, 88, 89, 93, 202, 206, 207, 50, 51, 52, 49.1, 49.2, 49.4, 49.5; 128/201.17, 201.22, 201.23, 201.24, 201.29, 204.18

[56] References Cited

U.S. PATENT DOCUMENTS

| | | | |
|---|---|---|---|
| D. 348,974 | 7/1994 | Whitwell . | |
| 1,560,997 | 11/1925 | Kelly . | |
| 2,368,272 | 1/1945 | Sydenham et al. | 2/84 X |
| 3,516,404 | 6/1970 | Spross . | |
| 3,529,594 | 9/1970 | Charnley . | |
| 3,635,206 | 12/1971 | Charnley . | |
| 3,868,728 | 3/1975 | Krzewinski . | |
| 4,055,173 | 10/1977 | Knab . | |
| 4,403,608 | 9/1983 | Warncke . | |
| 4,513,452 | 4/1985 | Rankin, Sr. et al. | 2/84 X |
| 4,586,196 | 5/1986 | White | 2/114 |
| 4,622,699 | 11/1986 | Spriggs | 2/114 |
| 4,651,727 | 3/1987 | Howorth . | |
| 4,831,664 | 5/1989 | Suda | 2/84 |
| 4,845,779 | 7/1989 | Wheeler et al. . | |
| 4,864,654 | 9/1989 | Schriver et al. | 2/84 |
| 4,901,370 | 2/1990 | Suda | 2/84 |
| 5,033,115 | 7/1991 | Bowling et al. . | |
| 5,042,474 | 8/1991 | Williamson | 128/206.12 |
| 5,088,115 | 2/1992 | Napolitano | 2/84 |
| 5,133,344 | 7/1992 | Jurrius et al. . | |
| 5,271,100 | 12/1993 | Holt | 2/114 |

FOREIGN PATENT DOCUMENTS

| | | | |
|---|---|---|---|
| 2715241 | 8/1978 | Germany | 2/84 |

*Primary Examiner*—Jeanette E. Chapman
*Attorney, Agent, or Firm*—Richard L. Myers

[57] ABSTRACT

A surgical gown is adapted to be operatively disposed to substantially cover a surgeon wearing a ventilator having a waist-mounted power unit, a head-mounted manifold structure, and at least one tube extending therebetween. The gown includes a head section, a waist section, and a shoulder section appropriately configured to cover analogous portions of the surgeon's body. A ventilator section, disposed between the head section and the waist section when the gown is operatively disposed on the surgeon, defines tube channel to receive the tube of the ventilator. This ventilator section forms an enlargement which facilitates movement of the head of the surgeon without substantial restriction by the head section of the gown. An interior tie gathers a front section of the gown around the neck of the surgeon to isolate movement between the head section and shoulder section. The front section of the gown is covered with a plastic laminate to render the gown impermeable to fluids emanating from the front of the surgeon.

10 Claims, 2 Drawing Sheets

SURGICAL GOWN

BACKGROUND OF THE INVENTION

1. Field of the Invention

This invention relates generally to surgical gowns and more specifically gowns adapted for use by operating room personnel wearing personal portable ventilation systems.

2. Discussion of the Prior Art

Surgical gowns have long been used to individually cover and protect the surgeon and his associates in the operating room. For example, gowns formed from non-woven fabrics have commonly been available to cover the surgeon from his neck down.

With the advent of diseases such as AIDS which are communicated by exposure to body fluids, protection for the surgeon has become of even greater concern. Accordingly, surgical gowns are now available with head sections so that not only the body but also the face and head of the surgeon are protected from body fluids which may be encountered during surgery. Where airborne particles and surgical smoke are present, the surgeon has been provided with a ventilation system which commonly includes a waist mounted power unit, a head mounted manifold structure, and at least one tube extending therebetween. To maximize airflow, the tubes have typically been connected to enter the manifold structure generally perpendicular to the back of the surgeon's head. As a result, they commonly extend rearwardly of the head of the surgeon several inches before running down the back of the surgeon to engage the power unit at his waist.

The ventilation tubes extending between the head and the waist of the surgeon have presented an annoying problem when used with surgical gowns of the prior art. While the head sections associated with these gowns have been sufficiently large to accommodate the head of the surgeon and the entire manifold structure, the rearwardly extending tubes have made this a very tight fit. Consequently, whenever the surgeon has turned his head, not only the head section but also the shoulder section of the gown has tended to rotate.

Gowns of the past have been formed from non-woven materials impregnated with plastic or bonded to plastic sheeting in order to prevent the passage of fluids through the material. In some cases, these impregnated materials have been breathable, however to permit the outward flow of air from the gown. However, such materials have been very expensive relative to the cost of materials not offering this breathable function. Where the less expensive materials have been used, ventilation of the interior regions of the gown has been important. The conflict between fluid impermeable materials and breathable materials has resulted in gowns which suffered from either a shortage of protection or a shortage of ventilation.

SUMMARY OF THE INVENTION

These deficiencies of the prior art have been overcome with the present invention which includes a surgical gown with a head section, a waist section, and a shoulder section disposed therebetween. The gown is specifically adapted for use by surgeon's wearing ventilation units of the type described. In a preferred embodiment, this adaptation comes in the form of a ventilation section disposed at the back of the gown which extends from the head section to the waist section. This ventilation section forms a tube channel which accommodates the tubes of the portable ventilator. The ventilation section may have a greater depth and width and proximity to the head section of the gown than at the waist section of the gown. This greater width provides additional space for the outwardly extending tubes at the back of the manifold structure. Accordingly, when the surgeon turns his head, there is less of a tendency for the head structure of the gown to rotate.

Even if the head section does rotate slightly, the gown includes an additional feature which isolates movement of the head section relative to the shoulder section of the gown. This feature includes an interior tie which engages the front of the gown in the region of the surgeon's neck and gathers at least a portion of that front section around the surgeon's neck.

A slit extending at the back of the gown provides access to this interior tie. In a preferred embodiment, the slit extends from the head section to a hem at the bottom of the gown. When the gown is donned by the surgeon, the interior tie is fixed and the slit closed by an appropriate structure such as a zipper. Waist ties can also be provided to gather the gown at the waist of the surgeon.

A compromise is provided between protection and ventilation in the construction of this gown. Realizing that contaminated body fluids will typically emanate from in front of the gown, the impermeable material is best located in this region. Since protection is of less value at the rear of the gown, the entire rear section can be formed from a ventilation material. Accordingly, the gown is formed with a side seam which extends up the sleeves, over the head section, and down the robe of the gown substantially dividing the gown into a front section which faces forwardly, and a rear section which faces rearwardly. Alternatively, the sleeves can be formed separately of an impermeable material and sewn or otherwise attached to the main body of the gown.

In one aspect of the invention, a surgical gown is adapted to be operatively disposed to substantially cover a surgeon wearing a ventilator system. The gown includes a head section sized and configured to receive the head of the surgeon, and a waist section disposed beneath the head section when the gown is operatively disposed on the surgeon. Also included is a shoulder section disposed between the head section and waist section and a ventilator section disposed between the head section and the waist section. The ventilator section forms a tube channel sized and configured to receive a tube of the ventilator system. The ventilation section forms an enlargement which facilitates movement of the head of the surgeon and the tube of the ventilator without substantial restriction by the head section of the gown.

In another aspect of the invention, the gown includes a head section, a shoulder section disposed beneath the head section, and means disposed between the head section and the shoulder section for gathering at least a portion of the gown around the neck of the surgeon in order to isolate movement of the head section from relative movement with the shoulder section of the gown.

In a further aspect of the invention, the surgical gown includes a front section entirely visible in a front view of the gown, and a rear section attached to the front section and entirely visible in a rear view of the gown. The front section and rear section are joined along a side seam to form an interior region of the gown. The front section is formed of a non-woven fabric impregnated with a fluid impermeable material to prevent surgical fluids emanating from in front of the gown from reaching the surgeon. The rear section is formed of a fabric permeable by air to cool the interior regions of the gown.

These and other features and advantages of the invention will be more apparent with the description of preferred embodiments and reference to the associated drawings.

DESCRIPTION OF PREFERRED EMBODIMENTS AND BEST MODE OF THE INVENTION

Figure 1:
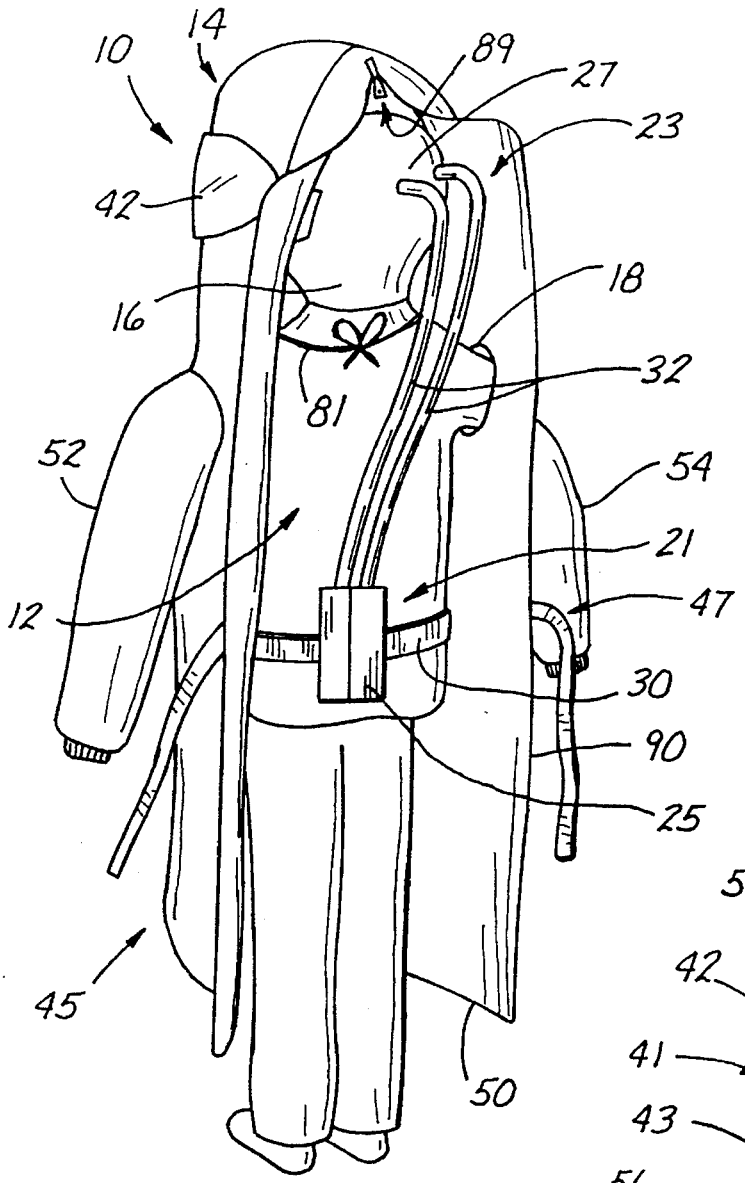
FIG. 1 is a rear perspective view of a surgical gown having an interior tie, as it is being donned by a surgeon wearing a portable ventilation system.

A surgical gown is illustrated in FIG. 1 and designated generally by the reference numeral 10. The gown 10 is adapted to be worn by personnel in an operating room, such as a surgeon 12, having a normal body structure including a head 14, neck 16, shoulders 18 and waist 21.

In order to facilitate a flow of filtered air into the gown 10, the surgeon 12 typically wears a portable ventilation system 23 including a power unit 25 and manifold structure 27. The power unit 25 is commonly supported by a belt 30 which extends around the waist 21 of the surgeon 12. While the manifold structure 27 is mounted on the head 14 of the surgeon 12. Filtered air from the power unit 25 is directed into the manifold structure 27 by at least one tube 32.

The ventilation system 23 can be of the type disclosed and claimed in applicant's U.S. Pat. Nos. 4,901,716 and 5,042,474. In these systems, the flow of air through the tubes 32 is maximized by a generally perpendicular relationship between the tubes 32 and the manifold structure 27 at the back of the surgeon's head 14. This perpendicular orientation of the tubes 32 adds significantly to the size and depth of the ventilation system 23 in proximity to the manifold structure 27.

Figure 2:
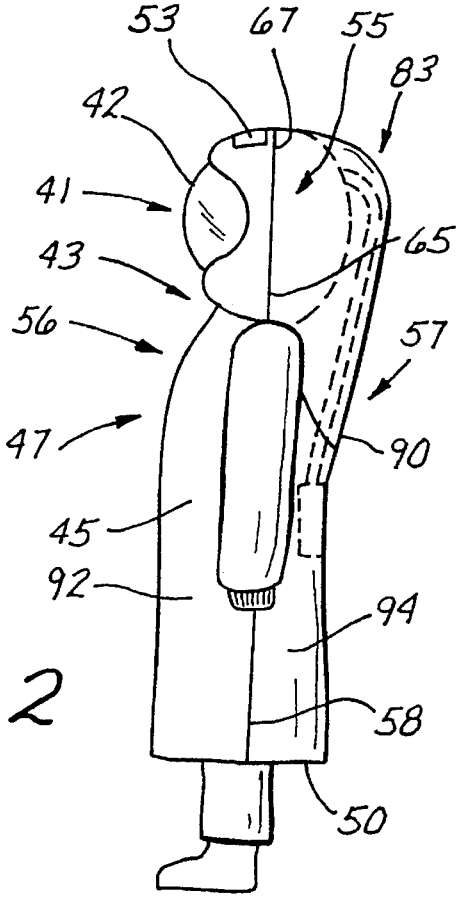
FIG. 2 is a side elevation view of the gown of FIG. 1 operatively disposed on the surgeon.

In the embodiments of FIGS. 1 and 2, the gown is provided with a head section 41 having a transparent window 42, a shoulder section 43, and a robe 45 which extends through a waist section 47 to a hem 50. Sleeves 52 and 54 extend from the shoulder sections 43 on the left and fight sides of the gown 10, respectively. In the gown 10, additional space is provided particularly behind the head section 41 in order to accommodate the tubes 32 of the portable ventilation system 23. The head section 41 may also include a filter patch 53 which can function to filter incoming and/or outgoing air.

Figure 3:
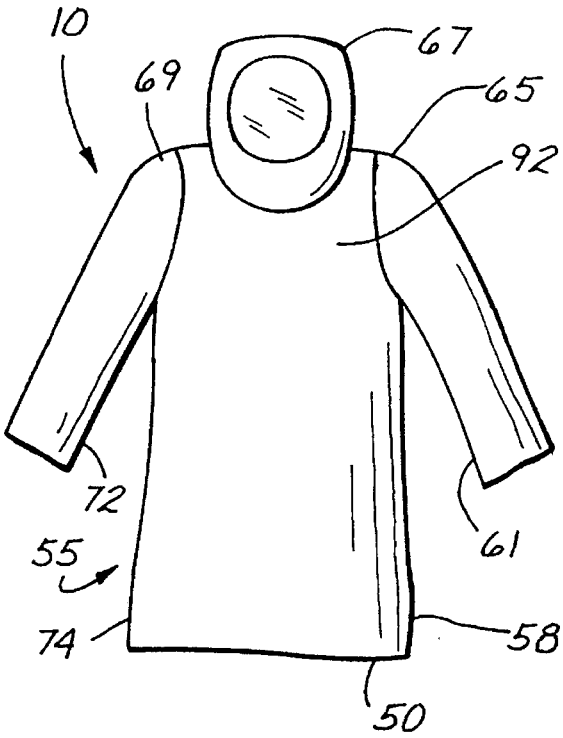
FIG. 3 is a front view of the gown illustrated in FIG. 1.

A side seam 55 extends on either side dividing the gown 10 into a front section 56 and a rear section 57. As best illustrated in FIG. 3, the side seam 55 includes on the left side of the gown a robe seam 58, an inside sleeve seam 61, a shoulder seam 65, and a head seam 67. The head seam 67 extends over the top of the head section 41 to the fight side of the gown 10 where the seam 55 includes a shoulder seam 69, inside sleeve seam 72 and robe seam 74. In the illustrated embodiment, the side seam 55 is substantially continuous except at the ends of the sleeves 52, 54.

In the past, gowns have suffered from the simultaneous movement of the head section and shoulder section, particularly when a surgeon wearing a ventilator system has turned his head. This problem is overcome in the present invention by gathering means such as a pair of ties 81 or a sewn-in elastic member, which can be provided between the head section 41 and shoulder section 43. In a preferred embodiment, the ties 81 engages at least a portion of the front section 56, and extends around the back of the surgeon's neck 16. Alternatively the ties 81 can be attached to the shoulder seams 65, 69.

The tie 81 is disposed interiorly of the gown 10 where the engaged portion of the front section 56 is held in proximity to the neck 16. This gathering means disposed between the head section 41 and shoulder section 43 tends to isolate the two sections so that movement of one does not promote movement of the other. Accordingly, the head section 41 and shoulder section 43 of the preferred embodiment move substantially independently as a result of this gathering means, such as the tie 81.

Freedom of head movement is further facilitated in the preferred embodiment by providing a ventilator section 83 in the gown 10 as best illustrated in the side view of FIG. 2. This ventilator section 83 forms a tube channel 84 which substantially increases the depth of the gown 10 behind the head section 41. This additional depth easily accommodates the rearwardly extending tubes 32 at the back of the manifold structure 27. With this increased volume in the region of the manifold structure 27, movement of the surgeon's head 14 and associated movement of the tubes 32 does not necessarily result in movement of the head section 41 or ventilator section 83. As illustrated in FIG. 2, the ventilator section 83 extends rearwardly from the head section 41 behind a plane represented by a dotted line 88 which extends vertically from the rear of the hem 50.

Figure 4:
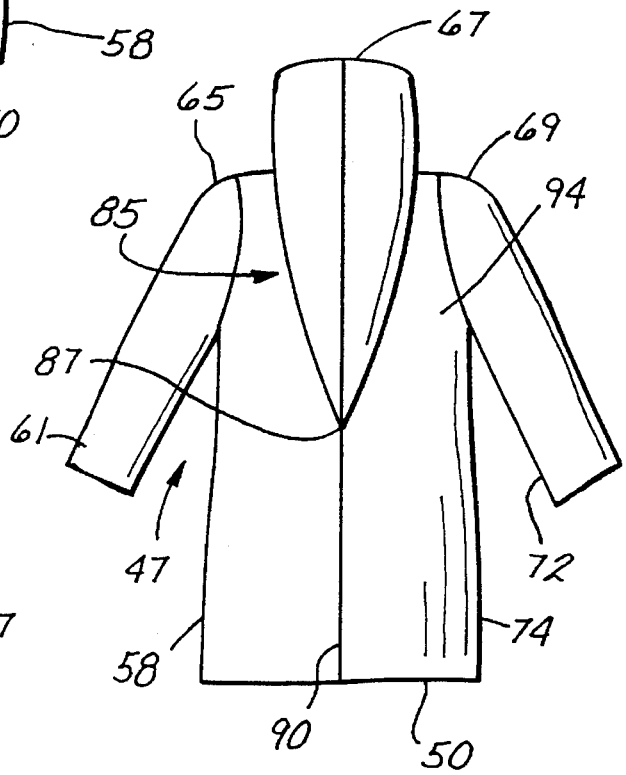
FIG. 4 is a rear view of the gown illustrated in FIG. 1.

A preferred configuration for the ventilator section 83 is illustrated in FIG. 4 to have a lateral dimension generally equal to that of the gown 10 in proximity to the head section 41. From the shoulder seams 65 and 69, the ventilator section extends downwardly along a taper 85 to a point 87 in proximity to the waist section 47. This configuration of the ventilator section 83 provides the greatest increase of volume in the vicinity of the head section 41 where the tubes 32 extend rearwardly from the manifold structure 27. As the tubes 32 travel down the back of the surgeon, less volume is required to accommodate the tubes 32.

Although the ventilator section 83 is particularly appreciated when used in combination with a manifold structure 27, the gown 10 functions equally well for ventilation systems which do not include a waist mounted power unit or associated tubes. With such ventilation systems, the extra volume provided by the ventilator section 83 still functions to facilitate separate movement of the head section 41 and the shoulder section 43.

At the back of the gown 10, a vertical slit is provided which can extend all or only a portion of the distance from the head seam 67 down the back of the ventilator section 83 and the robe 45 to the hem 50. A closure system such as a zipper 90 or hook and loop fastener, is commonly provided along the length of the slit 89.

The slit 89 is particularly valuable in facilitating entry and exit from the gown 10. It provides a very tall and wide opening through which the surgeon 12 can access the gown 10. It also provides an opening through which the gathering ties 81 can be engaged and tied around the neck 16 of the surgeon 12. Once the ties 81 are joined, the zipper 90 can be activated to close the slit 89 around the surgeon 12.

In the past, gowns have been formed from both fluid impermeable materials as well as generally porous materials. Where the impermeable materials have been accentuated, increased protection has been provided but only at a sacrifice to ventilation. Where the porous materials have been emphasized, cooler gowns have been formed but only at a sacrifice to protection.

The present invention appreciates that the surgeon 12 is at greatest risk from body fluids emanating from in front of the gown 10. For this reason, in a preferred embodiment all surfaces facing forward of the gown 10 are formed from a fluid impermeable material 92 such as a woven or non-woven fabric coated with a plastic laminate or impregnated to prevent the passage of fluids through the material. Since the surgeon 12 is much less at risk from fluids emanating from behind the gown 10, surfaces facing in this direction can be formed from a breatheable material 94.

In a preferred embodiment, the impermeable material 92 and breatheable material 94 are joined along the side seam 55. This seam 55 is illustrated on the perimeter of the gown 10 in both the front view of FIG. 3 and the rear view of FIG. 4. Accordingly, the impermeable material 92 is fully visible and the breatheable material 94 is fully hidden in the front view of FIG. 3. In contradistinction, the breatheable material 94 is fully visible and the impermeably material 92 is hidden in the rear view of FIG. 4.

Figure 5:
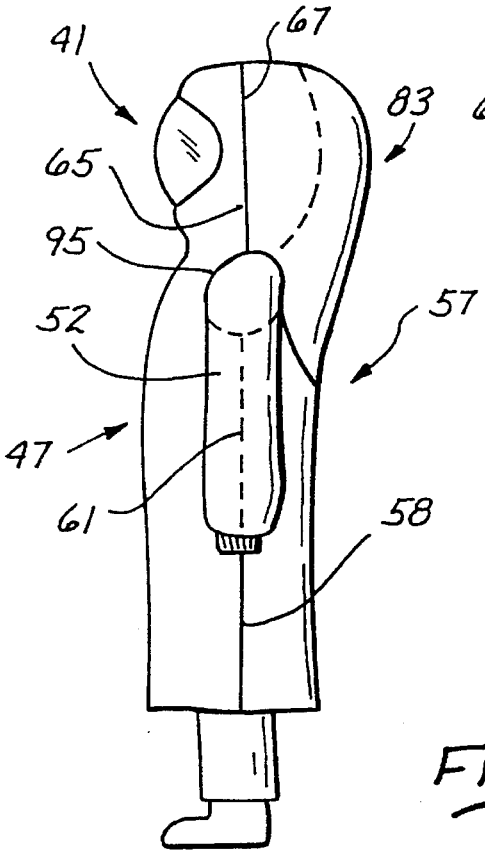
FIG. 5 is a side elevation view similar to FIG. 2 and illustrating an alternative embodiment wherein a cylindrical sleeve subassembly is attached to the remainder of the gown by a generally circular seam.

In an alternative embodiment illustrated in FIG. 5, the sleeves 52, 54 can be formed as subassemblies in a generally cylindrical configuration with only a single inside seam such as the seam 61. The sleeve 52 can then be attached to the remainder of the gown along a circular seam 95.

From the foregoing description of preferred embodiments, it will be apparent that many modifications in the gown 10 can be made while still capturing the advantages of the concept. Basically, any enlargement in the vicinity of the head section 41 will seek to provide additional volume so that the head of the surgeon, and attached manifold structure 27 and tube 32, can be turned without substantial movement of the head section 41. The ties 81 associated with the gathering means can be attached to the gown 12 around the entire region between the head section 41 and shoulder section 43. However, it is desirable that the ties 81 avoid the ventilator section 83 so that the tube channel 84 is unimpeded between the head section 41 and waist section 47.

Various impermeable and breatheable materials can be employed within the concept of the present invention with special advantages being achieved when these materials are joined along the side seam 55. The length and position of the slit 89 and closing zipper 90 can be varied, but preferably the slit 89 will provide access to the interior tie 81 at the neck 16 of the surgeon 12.

Given these wide variations, which are all within the scope of this concept, one is cautioned not to restrict the invention to the embodiments which have been specifically disclosed and illustrated, but rather encouraged to determine the scope of the invention only with reference to the following claims.

We claim:

1. A surgical gown adapted to be operatively disposed to substantially cover a surgeon wearing a ventilator including a wait mounted power unit, a head mounted manifold structure, and at least one tube extending therebetween, the gown having a front and a back and further comprising:

a head section sized and configured to receive the head of the surgeon;

a waist section disposed beneath the head section when the gown is operatively disposed on the surgeon, the wait section being sized and configured to receive the waist of the surgeon;

a shoulder section disposed between the head section and the waist section when the gown is operatively disposed on the surgeon, the shoulder section being sized and configured to receive the shoulders of the surgeon;

a ventilator section disposed between the head section and the waist section when the gown is operatively disposed on the surgeon, the ventilator section forming a tube channel extending along the back of the gown sized and configured to receive the at least one tube of the ventilator; wherein The ventilator section forms an enlargement on the back of the gown which facilitates movement of the head of the surgeon and the at least one tube of the ventilator without substantially restricting the movement of the head section of the gown.

2. The gown recited in claim 1 comprising:

a front section formed at the front of the gown when the gown is operatively disposed on the surgeon;

a rear section formed at the rear of the gown when the gown is operatively disposed on the surgeon; and a tie disposed around the neck of the surgeon between the neck of the surgeon and the tube of the ventilator, and between the head section and the shoulder section of the gown, the tie being operable to gather the front section of the gown but not the rear section of the gown, at the neck of the surgeon.

3. The surgical gown recited in claim 2 wherein:

portions of the rear section define a slit which extends generally vertically through the ventilator section; and the gown further comprises closure means extending along the slit to openably close the slit at the back of the surgeon.

4. The surgical gown recited in claim 2 wherein at least the front section of the gown is formed from a non-woven fabric impregnated with a fluid impermeable material.

5. A surgical gown adapted to be operatively disposed to substantially cover a surgeon wearing a ventilator including a waist mounted power unit, a head mounted manifold structure, and at least one tube extending therebetween, the gown comprising:

a head section sized and configured to receive the head of the surgeon;

a waist section disposed beneath the head section when the gown is operatively disposed on the surgeon, the waist section being sized and configured to receive the waist of the surgeon;

a shoulder section disposed between the head section and waist section when the gown is operatively disposed on the surgeon, the shoulder section being sized and configured to receive the shoulders of the surgeon;

a ventilator section disposed between the head section and the waist section when the gown is operatively disposed on the surgeon, the ventilator section forming a tube channel sized and configured to receive the at least one tube of the ventilator, the tube channel in proximity to the head section having a first width and in proximity to the waist section having a second width, and the first width being greater than the second width to permit lateral movement of the tube in proximity to the head of the surgeon; wherein the ventilator section forms an enlargement which facilitates movement of the head of the surgeon and the at least one tube of the ventilator without substantial restriction by the head section of the gown.

6. The surgical gown recited in claim 5 wherein:

the head section has a width;

the first width of the ventilator section in proximity to the head section is about the width of the head section; and the ventilator section tapers to the second width in proximity to the waist section of the gown.

7. The surgical gown recited in claim 6 wherein the ventilator section tapers from the first width in proximity to the head section to a point in proximity to the waist section of the gown.

8. A surgical gown adapted to be operatively disposed to substantially cover a surgeon using s ventilator system with a tube extending between the head and waist of the surgeon, the gown comprising:

a front section entirely visible in a front view of the gown;

a rear section attached to the front section and entirely visible in a rear view of the gown;

the front section and rear section being joined along a side seam to form an interior region sized and configured to receive the surgeon;

the front section being formed of a nonwoven fabric impregnated with a fluid impermeable material to prevent surgical fluids emanating from in front of the gown from reaching the surgeon in the interior regions of the gown;

a head section sized and configured to receive the head of the surgeon when the gown is operatively disposed on the surgeon;

a waist section disposed beneath the head section when the gown is operatively disposed on the surgeon, the wait section being sized and configured to receive the waist of the surgeon;

a ventilator section included in the rear section of the gown and extending between the head section and the waist section, the ventilator section defining a tube channel sized and configured to receive the tube of the ventilator system worn by the surgeon; wherein the ventilator section forms an enlargement on the rear section of the gown which facilitates movement of the head of the surgeon and the tube of the ventilator system without substantially restricting the movement head section of the gown.

9. The surgical gown recited in claim 8 further comprising:

the shoulder section disposed between the head section and the waist section when the gown is operatively disposed on the surgeon; and means for gathering at least the front section of the gown between the head section and the shoulder section to permit movement of one of the head section and shoulder section without substantial accompanying movement of the other of the head section and shoulder section of the gown.

10. The surgical gown recited in claim 8 further comprising portions of the rear section defining a vertical slit providing access through the rear section into the interior regions of the gown; and the gathering means includes a tie accessible through the slit and operable through the slit within the interior regions of the gown to gather the front section of the gown around the neck of the surgeon.

* * * * *